US006681402B1

(12) United States Patent
Bevier et al.

(10) Patent No.: US 6,681,402 B1
(45) Date of Patent: Jan. 27, 2004

(54) BALL GLOVE WITH A MATRIX STRUCTURE

(75) Inventors: Joseph J. Bevier, Portland, OR (US); Robert J. Ball, Lake Oswego, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/246,736

(22) Filed: Sep. 19, 2002

(51) Int. Cl.[7] ..... A41D 13/08
(52) U.S. Cl. ..... 2/19
(58) Field of Search ..... 2/19, 159, 161.1, 2/161.2, 161.3, 161.4, 161.6, 162, 167, 169, 16, 20; 601/40; 602/21

(56) References Cited

U.S. PATENT DOCUMENTS

| | | | | |
|---|---|---|---|---|
| 811,389 A | | 1/1906 | Ferry | |
| 859,097 A | | 7/1907 | Miller | |
| 883,761 A | | 4/1908 | Taylor | |
| 2,521,488 A | * | 9/1950 | Smith | 2/19 |
| 3,944,220 A | | 3/1976 | Fasano | |
| 4,353,362 A | | 10/1982 | DeMarco | |
| 4,525,877 A | * | 7/1985 | Chong | 2/163 |
| 4,766,612 A | | 8/1988 | Patton, Sr. | |
| 4,881,275 A | | 11/1989 | Cazares et al. | |
| 4,891,845 A | | 1/1990 | Hayes | |
| 4,937,882 A | | 7/1990 | Hayes | |
| 5,031,238 A | | 7/1991 | Hayes | |
| 5,214,798 A | | 6/1993 | McLaughlin | |
| 5,373,585 A | | 12/1994 | Wiggins | |
| 5,527,244 A | | 6/1996 | Waller et al. | |
| 5,544,362 A | | 8/1996 | Synek | |
| 5,697,103 A | | 12/1997 | Wiggins | |
| 5,708,979 A | | 1/1998 | Redwood et al. | |
| 5,740,555 A | | 4/1998 | Renegar | |
| 6,289,515 B1 | | 9/2001 | Fous | |
| 6,543,058 B2 | * | 4/2003 | Litke | 2/161.2 |

FOREIGN PATENT DOCUMENTS

| | | |
|---|---|---|
| JP | 7213675 | 8/1995 |

* cited by examiner

*Primary Examiner*—Gary L. Welch
(74) *Attorney, Agent, or Firm*—Banner & Witcoff, Ltd.

(57) ABSTRACT

A ball glove is disclosed having an open area on a dorsal side of the glove, the open area including a matrix that enhances the flexibility of the glove. The matrix may be formed of an elastomeric material having a plurality of interconnected segments that define open spaces between the segments. The matrix may also define a wrist opening that provides access for a hand of a wearer and surrounds a wrist of the wearer when the glove is worn, or the matrix may extend around the wrist. The ball glove may also include a lining formed of an air-permeable material that surrounds the hand.

39 Claims, 10 Drawing Sheets

BALL GLOVE WITH A MATRIX STRUCTURE

BACKGROUND OF THE INVENTION

1. Field of the Invention

The present invention relates to equipment for sporting activities. The invention concerns, more particularly, a baseball or softball glove with a matrix structure on a dorsal side of the glove to provide enhanced flexibility.

2. Description of Background Art

The primary components of a conventional baseball glove are a shell, a pocket, a lining, and lacing, which are generally formed from leather materials to provide both durability and protection for the hand. The main protective component is the shell, which is configured to extend over the hand, including the fingers. In general, the shell is formed from a palmar element and an opposite dorsal element that cover the palm and back of the hand, respectively. Whereas the palmar element is generally formed from full-grain leather that is both durable and protective, the dorsal element may be formed from leather or synthetic materials having a lesser weight.

The digit regions of the shell are configured to extend beyond the tips of the fingers. The pocket, which is located between portions of the shell that receive the thumb and index finger, also extends beyond the tips of the fingers to form an area for catching a baseball. During practice or competition, baseballs may be propelled by throwing or by hitting with a bat, for example, at velocities that exceed 160 kilometers per hour (approximately 100 miles per hour). Placement of the pocket beyond the tips of the fingers ensures that the baseball is caught in a portion of the glove that does not include the hand. That is, the pocket is located such that the forces associated with catching a baseball are not directly absorbed by the hand.

The lining, which may be formed from soft leather or a combination of synthetic materials, is located within the shell and provides a comfortable surface for contacting the hand. The lacing is used to secure the various baseball glove components together. For example, the lacing may join peripheral portions of the palmar and dorsal elements to secure the two elements together. In addition, the lacing may join the pocket to the shell.

When a baseball is caught by the conventional baseball glove, the pocket and a portion of the shell close around the baseball to securely hold the baseball. Accordingly, the palmar element is compressed and the dorsal element is stretched when a baseball is properly caught. When initially purchased, the leather materials that form most conventional baseball gloves are too stiff and inflexible to permit proper catching without a lengthy breaking-in process for the baseball glove. The initial stiffness of conventional baseball gloves is especially problematic for younger athletes or other athletes that lack the necessary hand strength and fast reaction time to quickly open and close the baseball glove around a baseball. In order to alleviate the stiff nature of new baseball gloves, athletes often spend a significant period of time bending, kneading, or otherwise conditioning the leather to make the leather more supple, thereby increasing the flexibility of the baseball glove. A baseball glove that eventually becomes more flexible, however, may remain too inflexible for younger athletes, who should be concentrating on hand-eye coordination and baseball playing strategy, rather than the mechanics of properly using an inflexible baseball glove. Accordingly, conventional baseball gloves fail to adequately serve athletes of all ages and abilities.

SUMMARY OF THE INVENTION

To address these problems, the present invention is a glove for receiving a hand of a wearer that includes a shell and a matrix. The shell is configured to cover fingers of the hand and a palmar surface of the hand. In addition, the shell defines an open area on a dorsal surface of the hand. The matrix is formed of a flexible material and has a plurality of interconnected segments that define openings located between the segments. The matrix is attached to the shell and located within the open area to cover the dorsal surface of the hand.

The combination of a shell and a matrix located in an open area on a dorsal surface of the shell is suited for use in gloves intended for athletic activities such as baseball and softball. Accordingly, a dorsal portion of a baseball glove may define the open area, with the matrix being located within the open area. An advantage gained by this configuration is enhanced flexibility of the baseball glove. As discussed in the Description of Background Art section, conventional baseball gloves are generally formed of all-leather components. When catching a baseball, the wearer often closes the baseball glove around the baseball, which requires stretching the dorsal surface of the glove. When formed from leather, closing the glove may be difficult until the baseball glove is properly broken in, a process that may require a significant period of time. By replacing a portion of the dorsal surface with the matrix, the flexibility of the glove of the present invention is enhanced, thereby decreasing the force required to close the glove around a ball.

The structure of the matrix may vary significantly within the scope of the present invention to include a multiplicity of designs that are formed from interconnected segments that define openings located between the segments. The matrix may have, for example, an interconnected structure that is formed of an elastomeric material with flexible, resilient properties. The matrix may also have a structure that forms a wrist opening for surrounding a wrist of the wearer when the glove is worn.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF EMBODIMENTS OF THE INVENTION

Figure 1:
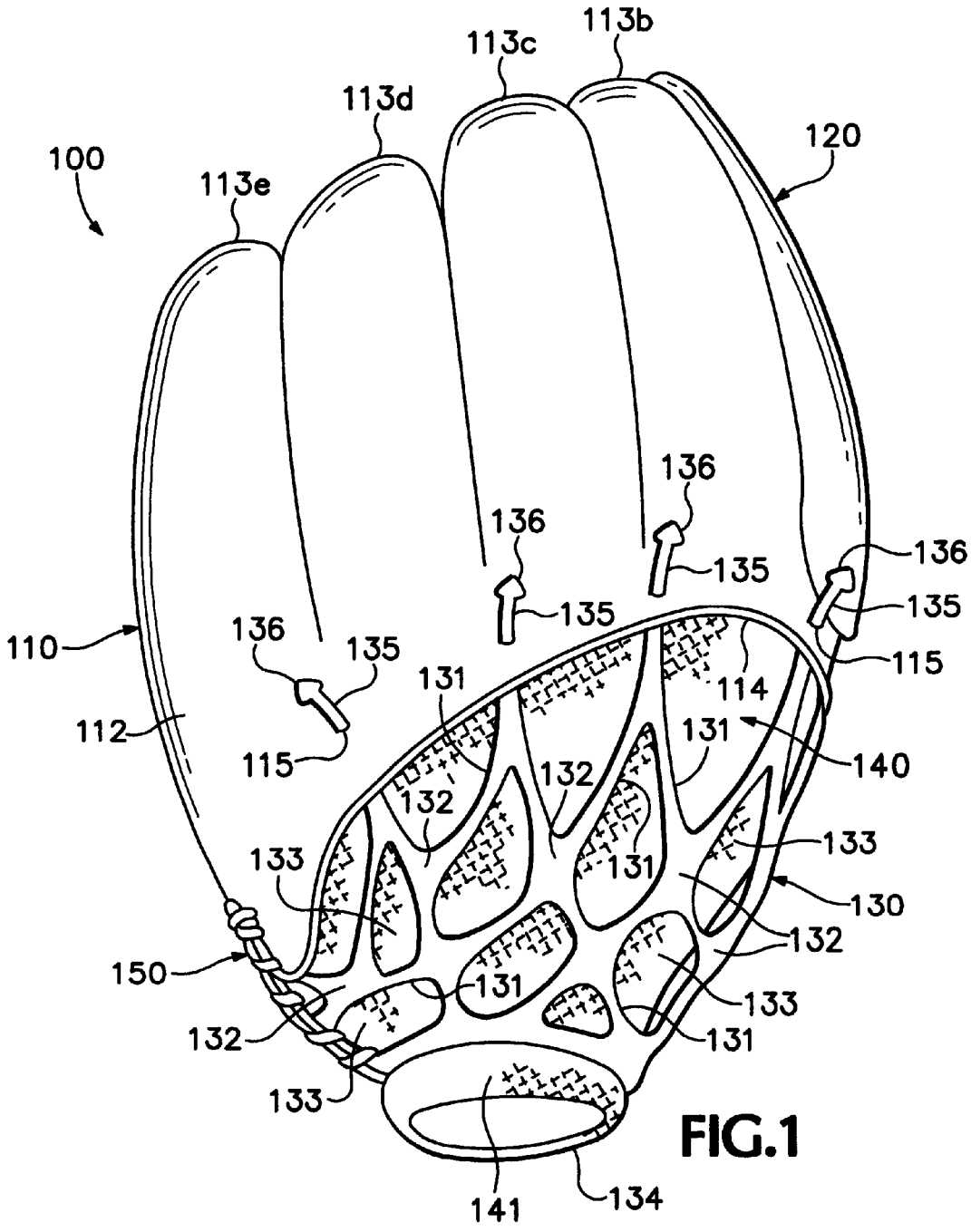
FIG. 1 is a dorsal and lateral perspective view of a first glove in accordance with the present invention.

The figures and following discussion disclose a glove 100 and a glove 200 in accordance with the present invention. Gloves 100 and 200 are depicted in the figures and discussed in the following material as baseball gloves that include novel features for enhancing flexibility and breathability, reducing overall weight, and providing enhanced fit. These features are particularly suited to gloves that are intended for use during baseball, but may be applied to gloves that are intended for similar athletic activities, including softball. In addition, the concepts disclosed below may be applied to a variety of other glove styles, whether athletic or non-athletic. Accordingly, the present invention is not intended to be limited solely to baseball gloves, but may be applied to gloves designed for a wide range of activities.

The following discussion includes a disclosure of the structure and features of both glove 100 and glove 200. Initially, glove 100 will be discussed to provide a general understanding of the structure and features associated with the present invention.

Following the discussion of glove 100, glove 200 will be discussed to demonstrate exemplar variations upon the general structure of glove 100. One skilled in the relevant art will recognize, however, that a plurality of other modifications may be made to the structures of glove 100 and glove 200 without departing from the scope of the present invention.

Glove 100 is depicted in FIGS. 1–4 and includes a shell 110 that generally covers the hand, a pocket 120 that forms an area for catching a ball, a flexible matrix 130 that generally covers a portion of the dorsal side of the hand, a lining 140 that contacts the hand, and lacing 150 that secures portions of glove 100 together. In contrast with conventional baseball gloves, shell 110 is configured to cover only a portion of the dorsal side of the hand, with matrix 130 covering the remaining portion. Whereas relatively stiff leather is conventionally placed on the dorsal side of baseball gloves, matrix 130 is flexible, thereby increasing the overall flexibility of glove 100. Matrix 130 is also adjustable to enhance the fit of glove 100. Furthermore, the reduction in leather on the dorsal side of glove 100 provides reduced weight in comparison with conventional baseball gloves, and the combination of matrix 130 and lining 140 provides enhanced breathability.

Shell 110 is configured to form an interior cavity that receives the hand. In the following discussion the various portions of shell 110, and other elements of glove 100, will be discussed with reference to adjacent portions of the hand and wrist, including a palmar side of the hand, a dorsal side of the hand, various fingers or phalangeal bones, metacarpal bones, wrist bones, and joints between the various bones. One skilled in the relevant art will recognize that hands have a multiplicity of shapes and sizes. Accordingly, references to the various portions of the hand are only meant to provide a general understanding regarding the location of the various elements of glove 100.

The primary elements of shell 110 are a palmar element 111, which generally covers a palmar side of the hand, and a dorsal element 112, which generally covers a portion of the dorsal side of the hand. Palmar element 111 may be attached to dorsal element 112 in a conventional manner, which includes stitching, for example. Lacing 150 may also be utilized to reinforce the connection between palmar element 111 and dorsal element 112 in areas adjacent to the wrist. In addition to forming the cavity within glove 100 that receives the portion of the hand corresponding with the metacarpal bones, palmar element 111 and dorsal element 112 cooperatively form five digit regions 113*a*–113*e* that receive the thumb, index finger, middle finger, ring finger, and pinky finger of the wearer, respectively.

Figure 2:
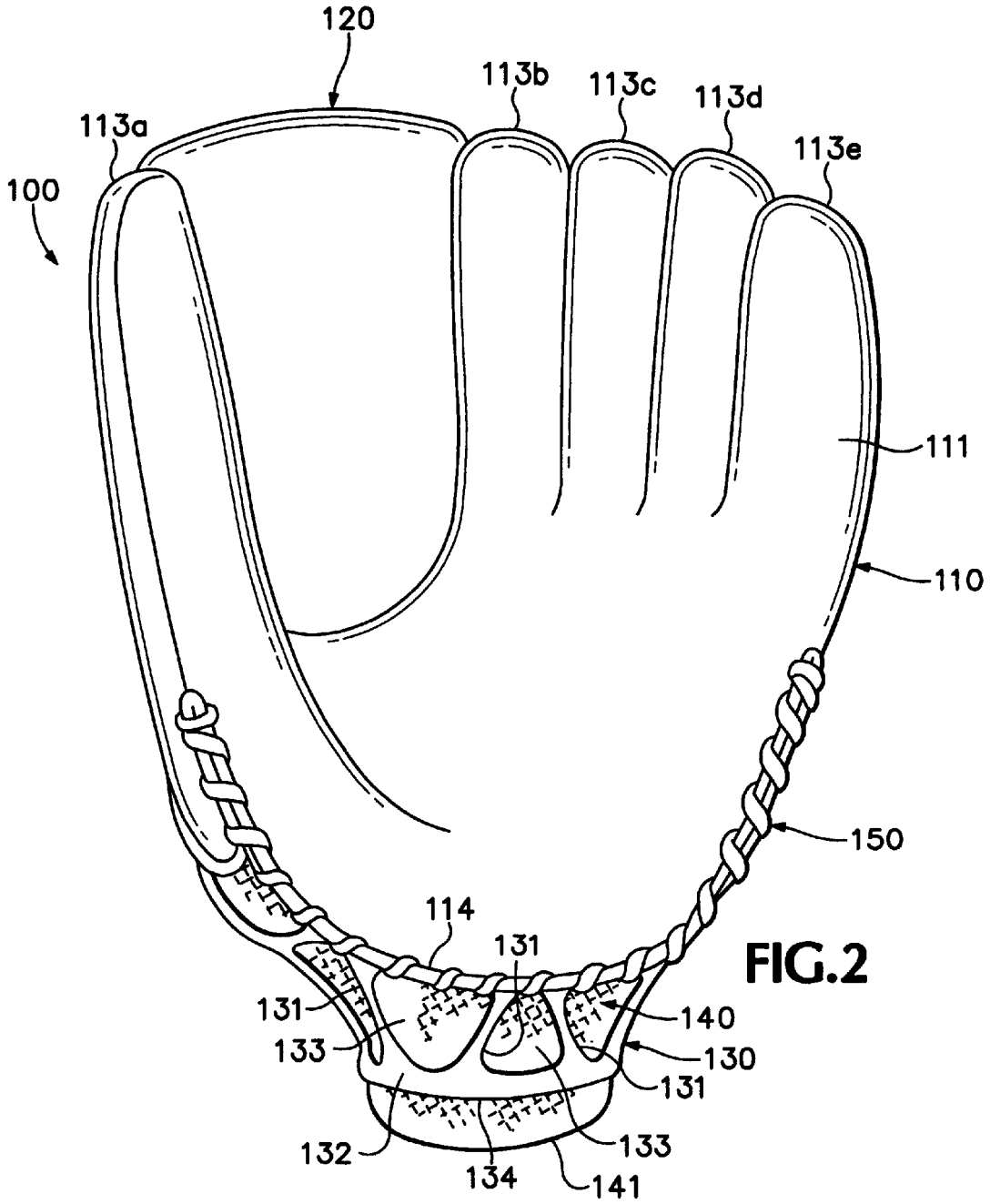
FIG. 2 is a palmar perspective view of the first glove.
Figure 3:
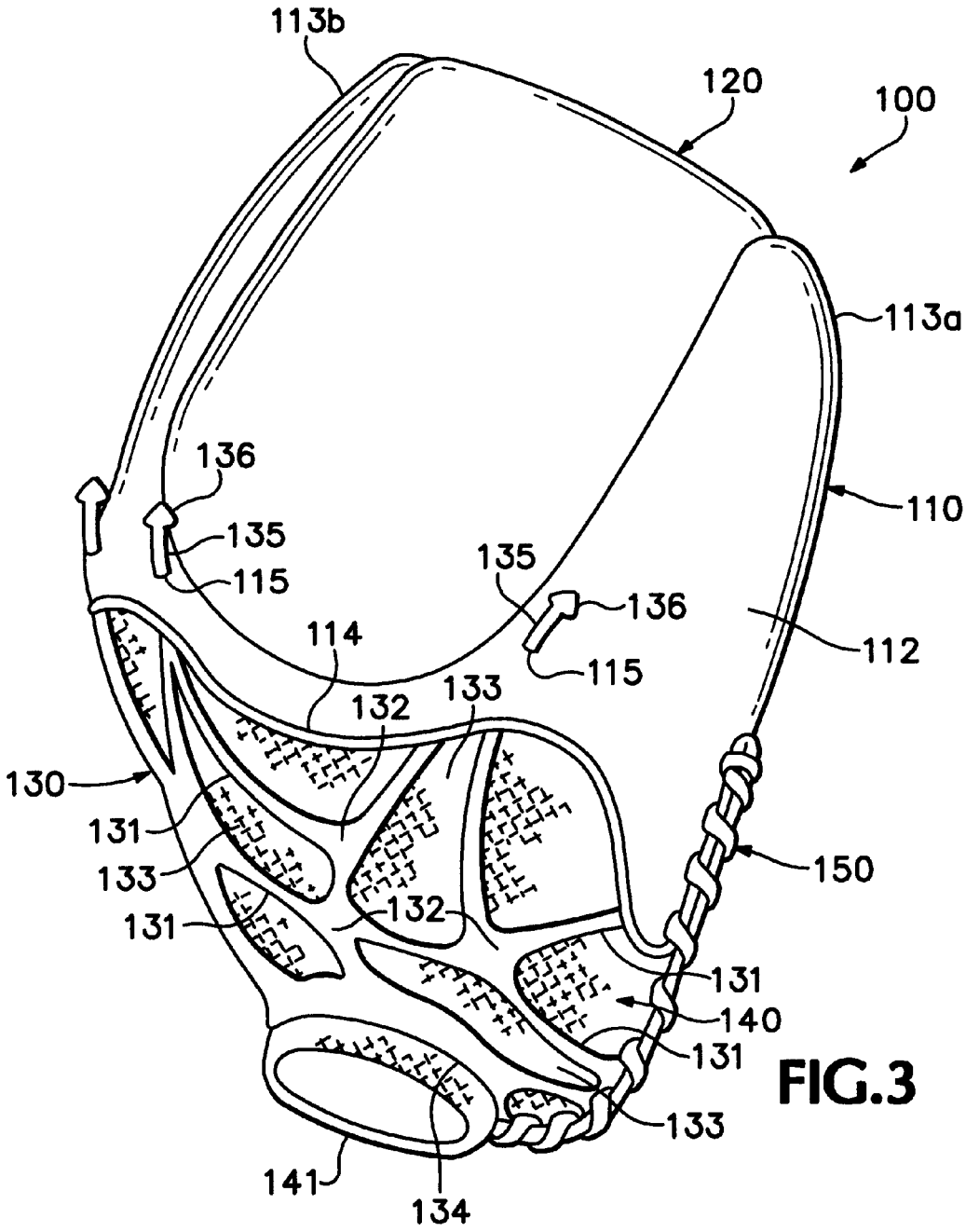
FIG. 3 is a dorsal and medial perspective view of the first glove.

In a conventional baseball glove, the palmar element covers the palmar surface of the hand, and the dorsal element covers the entire dorsal surface of the hand and a portion of the wrist. In contrast, dorsal element 112 covers a portion of the dorsal side of the hand. The lower boundary of palmar element 111 and dorsal element 112 is represented in FIGS. 1–3 by lower edge 114. The precise location of lower edge 114 may vary within the scope of the present invention. With respect to palmar element 111, as depicted in the figures, lower edge 114 may be located adjacent the joints between the bones of the wrist and the metacarpals. With respect to dorsal element 112, as depicted in the figures, lower edge 114 is further removed from the wrist than on the palmar side and may be located adjacent lower portions of the fingers. In general, therefore, shell 110 may have the general configuration of a shell for a conventional baseball glove, except for the extent to which dorsal element 112 covers the dorsal side of the hand and the wrist.

The materials selected for shell 110 should have sufficient durability to withstand repetitive use during activities such as baseball, and should provide protection to the hand when catching a baseball. Suitable materials for shell 110 are, therefore, leather, synthetic leather materials, or a combination of leather and synthetic materials. More specifically, palmar element 111 may be formed from full-grain leather, and dorsal element 112 may be formed from a leather having lesser weight.

Pocket 120 is positioned between digit regions 113*a* and 113*b*, which correspond respectively with the thumb and index finger. The purpose of pocket 120 is to form an area for catching a baseball. Due to the relatively high velocities that baseballs achieve during competition or practice, pocket 120 is located in a portion of glove 100 that does not include portions of the hand, thereby preventing a single portion of the hand from directly absorbing the impact forces associated with catching the baseball. Digit regions 113*a*–113*e* and pocket 120 are configured to extend beyond the tips of the fingers, therefore, to enlarge the area for catching a baseball and ensure that the area for catching a baseball is removed from the portion of glove 100 that receives the hand. The leather materials forming pocket 120 are typically separate from shell 110 and connected to shell 110 in a conventional manner. The specific design of pocket 120 may vary within the scope of the present invention, and could be configured to have one of the multiplicity of designs that characterize prior art pockets, including a woven structure or a structure that is formed of leather strips that are laced together.

Figure 4:
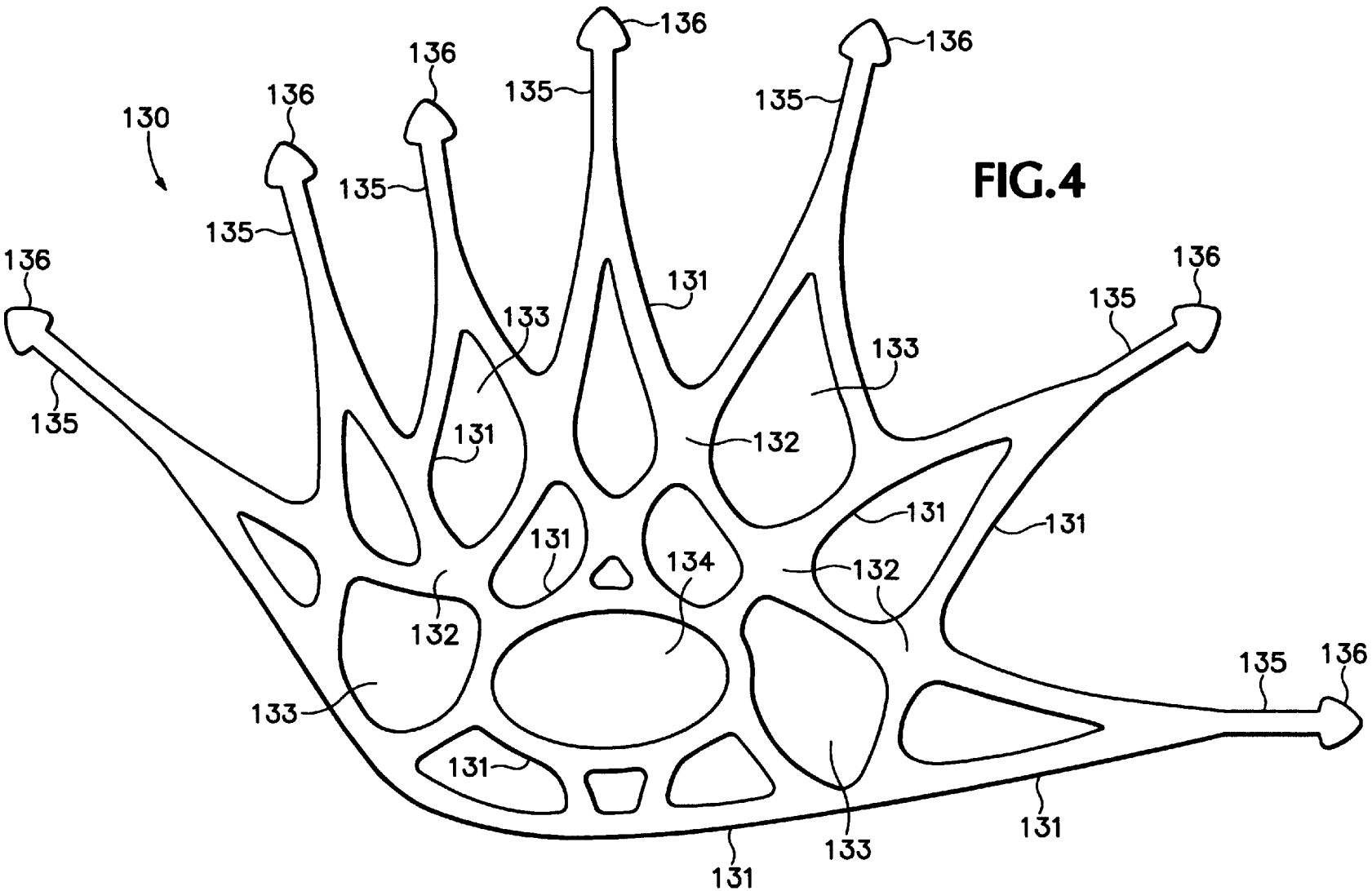
FIG. 4 is a plan view of a matrix element of the first glove.

Matrix 130, which is depicted individually in FIG. 4, is attached to shell 110 and extends over portions of the hand and wrist that are not covered by shell 110. The specific structure of matrix 130 may vary significantly within the scope of the present invention to include any flexible structure that has an interconnected configuration. In comparison with leather materials that are located on the dorsal side of the hand in conventional baseball gloves, matrix 130 has greater flexibility. When glove 100 is being closed upon a baseball, the flexibility of matrix 130 enhances the probability that the baseball will remain securely positioned within the area formed by pocket 120. In addition to flexibility, matrix 130 may also stretch, thereby providing glove 100 with further flexibility.

With respect to the figures, matrix 130 is depicted as an interconnected structure that extends over the dorsal side of the hand and around the wrist. In general matrix 130 is formed of a multiplicity of segments 131 that are interconnected at junctions 132 to form a flexible, web-like structure. Accordingly, a plurality of openings 133 are formed between segments 131, including a wrist opening 134 that extends around the wrist when glove 100 is being worn. In addition, matrix 130 includes a plurality of extensions 135 and end segments 136 that attach matrix 130 to shell 110.

The structure of matrix 130 may vary significantly within the scope of the present invention. In general, matrix 130 will include a plurality of segments 131 that are attached to other segments at junctions 132 to form openings 133. In other embodiments of the present invention, however, matrix 130 (or other matrices) may not have structures that correspond with wrist opening 134 and extensions 135. As will be discussed in relation to glove 200, matrix 130 may merely wrap around the wrist, or may only cover a dorsal portion of the wrist, for example.

The configuration of each segment 131 may also vary significantly. Segments 131 may have a straight or curved configuration, for example, or selected segments 131 may have a series of curves to provide a wave-like configuration. The cross-sectional shape of segments 131 may also be modified. For example, segments 131 may have a flat portion adjacent to the hand and an opposite surface that is curved, or segments 131 may also be round, square, or triangular. In order to provide varying properties to different portions of matrix 130, the configuration of segments 131 may vary within matrix 130 such that segments 131 having a first configuration are interconnected with segments 131 having a second configuration. Furthermore, segments 131 may be integrally-formed with each other to form a unitary structure, or each segment 131 may be individually formed and subsequently attached together at junctions 132.

A benefit of configuring segments 131 to have a curved configuration is that initial stretching of matrix 130 operates to bend segments 131, thereby straightening segments 131 rather than stretching segments 131. In general, bending segments 131 will require less force than stretching segments 131, thereby increasing the initial flexibility of glove 100. In operation, therefore, segments 131 having a curved configuration will have two stages of stretch. In the first stage, segments 131 merely bend or straighten. As noted above, bending of segments 131 requires less force. Accordingly, the initial flexibility in curved segments 131 is relatively high as segments 131 bend through the first stage. In the second stage, which follows the first stage, the flexibility becomes more firm as segments 131 are stretched longitudinally, rather than merely bent.

A variety of materials are suitable for matrix 130, including a plurality of elastomeric materials such as natural rubber, nitrile rubber, polysulfide rubber, ethylene-propylene rubber, neoprene, butyl, latex, balata, ELASTOLLAN, which is a thermoplastic polyurethane elastomer that is produced by BASF Corporation, or PEBAX, which is a polyether block amide that is produced by Atofina Chemicals. Accordingly, for purposes of the present invention, the terms elastomer or elastomeric materials are intended to encompass a wide range of materials that are elastic and resilient, in addition to rubber. Other suitable materials for matrix 130 include materials that are not generally considered elastomers, but have properties that provide flexibility and strength that is sufficient for use with matrix 130, including chains formed of metals, synthetic leather, or natural leather, for example.

Although segments 131 may be arranged to form a plurality of matrix configurations, the specific configuration of matrix 130 is dependent upon the intended application, the material utilized, and other factors. As discussed above, matrix 130 is formed of a flexible material. In addition, the material selected for matrix 130 may also stretch in the presence of a tensile force. Depending upon the degree of flexibility and stretchability inherent in the material utilized, the configuration of matrix 130 may be selected to provide suitable medial-lateral stretch, for example. A further consideration, however, is the manner in which matrix 130 secures the hand within glove 100. Lower edge 114 may be located adjacent the joints that connect the metacarpal bones with the various fingers. Accordingly, a significant portion of the hand is restrained from movement by the combination of matrix 130 and lining 140. The rigidity of matrix 130 should, therefore, be sufficient to securely enclose and position the hand, and if the material selected for matrix 130 is too stretchable, then this function will not be adequately achieved.

Segments 131 form a wrist opening 134 for receiving the wrist to further assist in restraining movement of the hand. Conventional baseball gloves include an opening formed in the leather that may include a hook and pile fastener to adjust the size of the opening. When placing the hand within glove 100, however, the wearer may stretch wrist opening 134 to accommodate entry of the hand. Once the hand is placed within glove 100, wrist opening 134 will contract to form an aperture that is smaller than the hand and encompasses the wrist. This structure prevents the hand from being inadvertently released from glove 100, thereby providing a further restraint against hand movement. As discussed below with respect to glove 200, however, hook and pile fasteners or other types of fasteners may be utilized to adjust the dimensions of wrist opening 134.

Matrix 130 also includes a plurality of extensions 135 having enlarged end portions 136 for attaching matrix 130 to shell 110. Extensions 135 are structures that are similar to segments 131, but are only attached to matrix 130 on one end, thereby providing a free end. Shell 110 includes a number of apertures 115 that are located adjacent to lower edge 114. Extensions 135 extend through apertures 115 such that end portions 136 prevent extensions 135 from being easily withdrawn from aperture 45. This structure effectively secures matrix 130 to shell 110. As discussed above, one function of matrix 130 is to restrain movement of the hand. Wearers with various hand sizes may foreseeably utilize glove 100. Extensions 135 provide a manner in which matrix 130 may be adjusted to reduce or enlarge the volume within glove 100, thereby adjusting glove 100 to accommodate the various hand sizes. In order to adjust glove 100, the wearer may pull on end portions 136 to draw a greater portion of extensions 135 through apertures 115, thereby lessening the total area of matrix 130 and cinching matrix 130 against the hand. Various structures may be utilized to secure the positions of extensions 135 relative to apertures 115, including friction or compression locks, a buckle, or a cord lock, for example.

Lining 140 is located within the cavity formed by shell 110 and matrix 130 to provide a breathable and comfortable surface for contacting the hand. Conventional baseball gloves provide the hand with a relatively small degree of breathability and trap both moisture and heat within the glove. In contrast, glove 100 may utilize a material for lining 140 that is breathable and wicks moisture away from the surface of the hand. Materials that may be utilized for lining 140 include woven or non-woven textiles, and, specifically, lining 140 may be formed from textiles that include nylon, polyester, or elastane.

Lining 140 may have the configuration of a glove with individual finger elements for extending over the fingers of the wearer, and surfaces for covering the palmar and dorsal sides of the hand. Alternately, lining 140 may extend only over the open area of dorsal element 112, or lining 140 may form an first area for receiving the thumb and a second area for receiving the remaining fingers. The specific configuration of lining 140 and the portions of the hand that are covered by lining 140 may vary significantly. Lining 140 may also include a cuff 141 that is attached to wrist opening 134 to provide a comfortable member for contacting the wrist.

Further durability for glove 100 is provided by lacing 150, which attaches matrix 130 to shell 110 on the medial, lateral, and palmar sides of glove 100. Lacing 150 may be strips of leather or synthetic materials that extend around portions of matrix 130 and are sewn or otherwise attached to shell 110. Alternately, lacing 150 may be absent if stitching or other methods of securing portions of shell 110 together and attaching matrix 130 to shell 110 are sufficiently durable.

Glove 100 provides advantages over conventional baseball gloves. In contrast with the stiff leather that is conventionally placed on the dorsal side of baseball gloves, matrix 130 is flexible, thereby increasing the overall flexibility of glove 100. This provides an advantage to athletes of all ages and skill levels in that less break-in time is required for glove 100. In addition, athletes that do not have the strength to competently close a conventional baseball glove will benefit from the improved overall flexibility of glove 100. Whereas conventional baseball gloves may be loose and cannot be sufficiently adjusted for hands of various sizes, matrix 130 is adjustable to enhance the fit of glove 100. Different individuals with various hand sizes may, therefore, utilize glove 100. As an athlete grows, matrix 130 may be adjusted to accommodate changes in hand sizes, thereby permitting a child to utilize one glove for a longer period of time. Furthermore, the reduction in leather on the dorsal side of glove 100 provides glove 100 with reduced weight in comparison with conventional baseball gloves. The weight of all-leather baseball gloves may increase the response time of athletes when attempting to catch a baseball. By reducing the weight of glove 100, response time may be decreased thereby enhancing the wearer's abilities, Finally, lining 140, which is formed of an elastic material, encompasses the hand to provide enhanced comfort and breathability.

Glove 200 is depicted in FIGS. 5–9 and includes a shell 210 that generally covers the hand, a pocket 220 that forms an area for catching a ball, a flexible matrix 230 that generally covers a portion of the dorsal side of the hand, a lining 240 that contacts the hand, and lacing 250 that secures portions of glove 100 together. Matrix 230 may be formed of a flexible material, thereby increasing the overall flexibility of glove 100. Furthermore, the reduction in leather on the dorsal side of glove 200 provides reduced weight in comparison with conventional baseball gloves, and the combination of matrix 230 and lining 240 may provide enhanced breathability.

The primary elements of shell 210 are a palmar element 211, which generally covers a palmar side of the hand, and a dorsal element 212, which generally covers a portion of the dorsal side of the hand. Palmar element 211 may be attached to dorsal element 212 in a conventional manner, which includes stitching, for example. Lacing 250 may also be utilized to reinforce the connection between palmar element 211 and dorsal element 212 in areas adjacent to the wrist. In addition to forming the cavity within glove 100 that receives the portion of the hand corresponding with the metacarpal bones, palmar element 211 and dorsal element 212 cooperatively form five digit regions 213*a*–213*e* that receive the thumb, index finger, middle finger, ring finger, and pinky finger of the wearer, respectively. Accordingly, shell 210 is similar in construction to shell 110, as discussed above.

Figure 5:
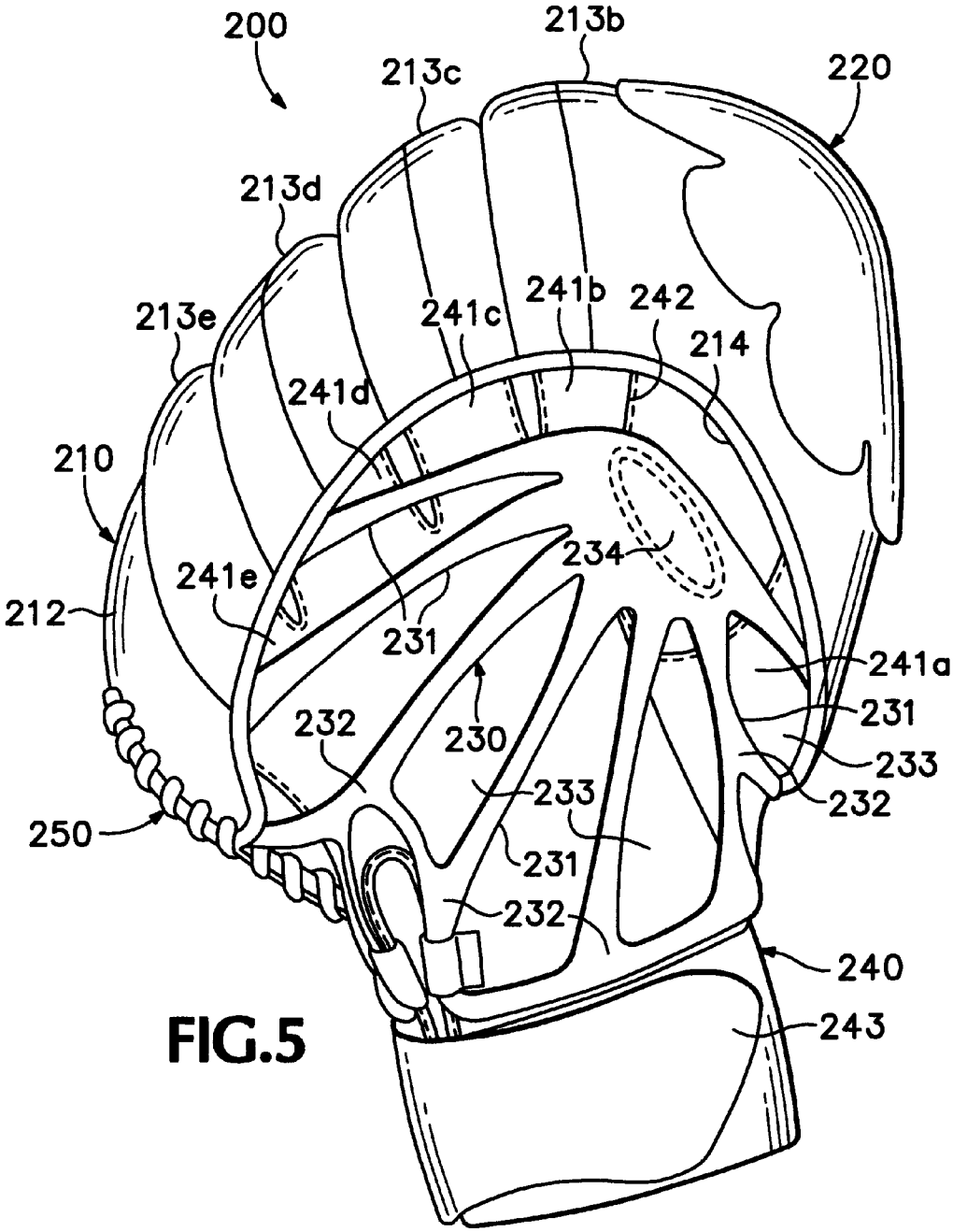
FIG. 5 is a dorsal perspective view of a second glove in accordance with the present invention.
Figure 6:
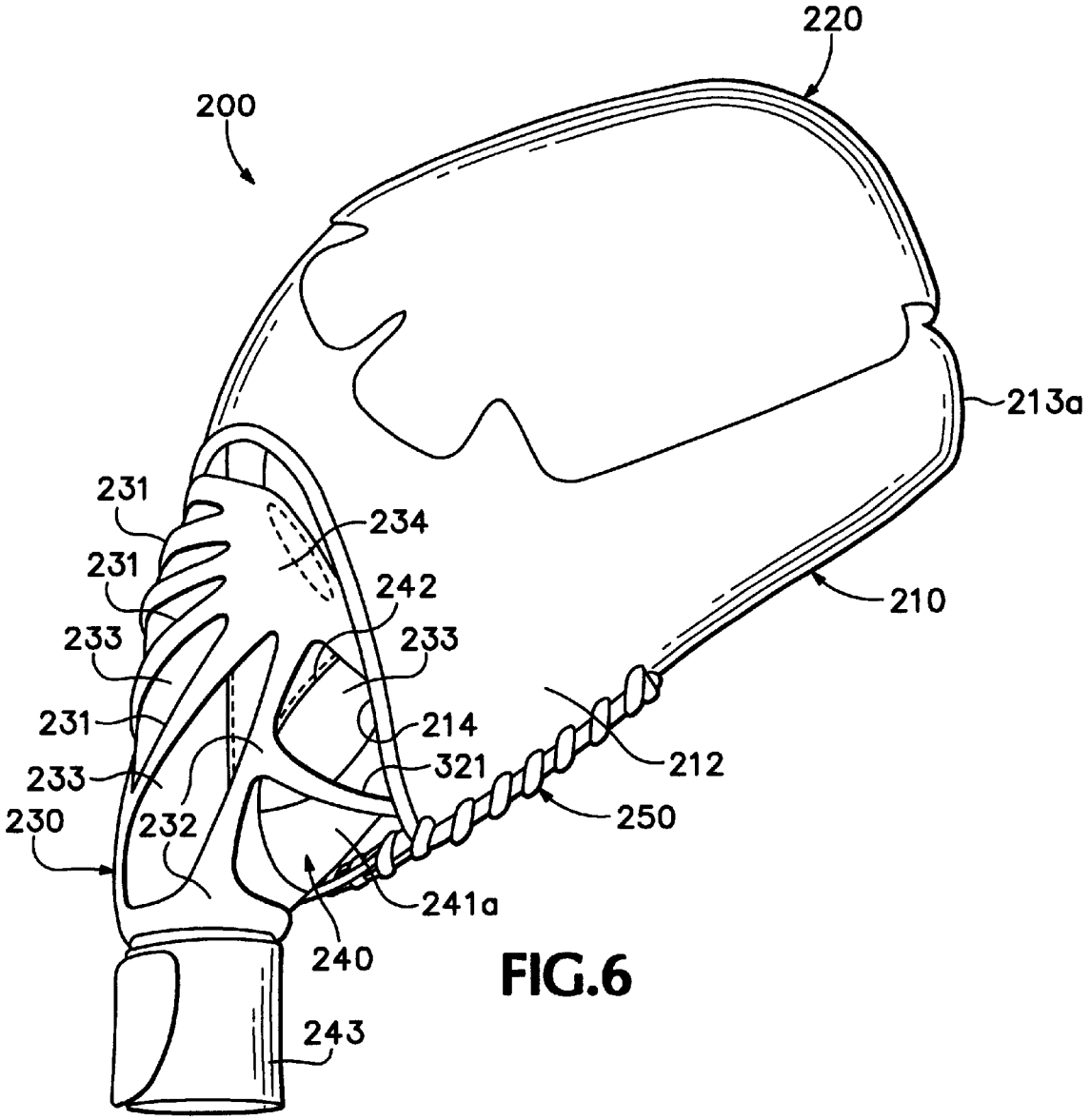
FIG. 6 is an elevational view of the second glove.
Figure 7:
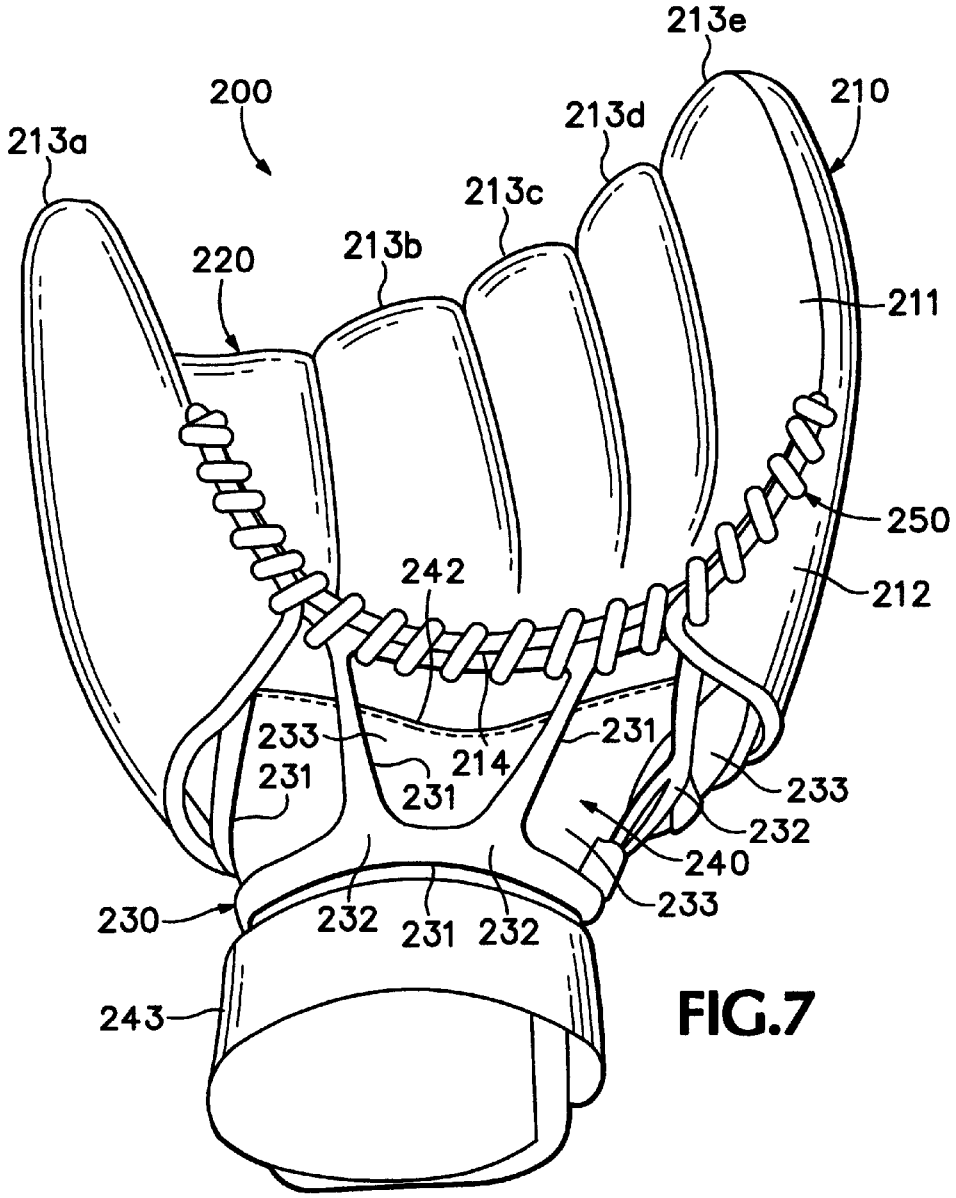
FIG. 7 is a palmar perspective view of the second glove.

Dorsal element 212 covers only a portion of the dorsal side of the hand. The lower boundary of palmar element 211 and dorsal element 212 is represented in FIGS. 5–7 by lower edge 214. The precise location of lower edge 214 may vary within the scope of the present invention. With respect to palmar element 211, as depicted in the figures, lower edge 214 may be located adjacent the joints between the bones of the wrist and the metacarpals. With respect to dorsal element 212, as depicted in the figures, lower edge 214 is further removed from the wrist than on the palmar side and may be located adjacent lower portions of the fingers. In general, therefore, shell 210 may have the general configuration of a shell for a conventional baseball glove, except for the extent to which dorsal element 212 covers the dorsal side of the hand and the wrist. Suitable materials for shell 210 are, for example, leather, synthetic leather, or a combination of leather and synthetic materials. More specifically, palmar element 211 may be formed from full-grain steer hide, and dorsal element 212 may be formed from a leather having lesser weight.

Pocket 220 is positioned between digit regions 213*a* and 213*b*, which correspond respectively with the thumb and index finger. As with pocket 120, the purpose of pocket 220 is to form an area for catching a baseball. The specific design of pocket 220 may vary within the scope of the present invention, and could be configured to have one of the multiplicity of designs that characterize prior art pockets, including a woven structure or a structure that is formed of leather strips that are laced together.

Figure 8:
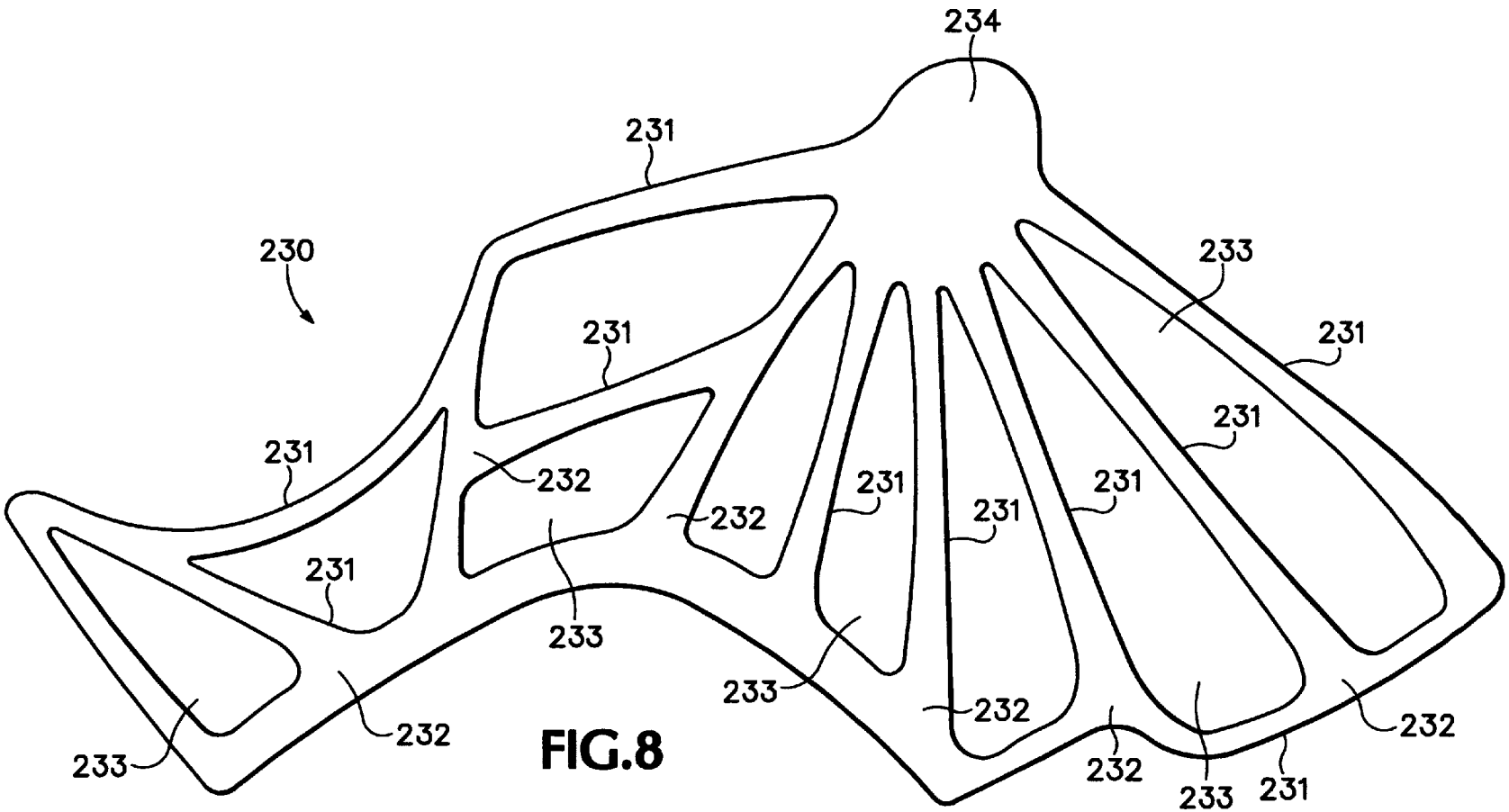
FIG. 8 is a plan view of a matrix element of the second glove.

Matrix 230, which is depicted individually in FIG. 8, is attached to shell 210 and extends over portions of the hand and wrist that are not covered by shell 210. Matrix 230 provides a second example of a matrix element that is suitable for the present invention. In general, matrix 230 is formed of a multiplicity of segments 231 that are interconnected at junctions 232 to form a flexible structure with a plurality of openings 233 located between segments 231.

Matrix 130 and matrix 230 are both depicted and discussed as interconnected structures that extend over the dorsal side of the hand and around the wrist. As discussed above, any interconnected structure formed of a flexible material maybe utilized for matrices 130 and 230, and the manner in which segments 131 and 231 are connected to form matrices 130 and 230 may vary significantly, as evidenced by the differences between the structures of matrix 130 and matrix 230. Whereas matrix 130 forms a web-like structure, matrix 230 form a radial pattern on at least the dorsal side of the hand. Referring to FIG. 5, segments 231 located on the dorsal side of the hand extend radially outward from an area 234 located adjacent pocket 220. The radial pattern of segments 231 provides flexibility in multiple directions. Matrix 130 forms a wrist opening 134 for receiving the hand and wrist of the wearer. In contrast, matrix 230 wraps around the wrist and is secured to lining 240 in the wrist area, thereby forming a wrist opening. In further embodiments, matrix 230 may be positioned solely on the dorsal side of the hand, rather than extending around the wrist.

Many of the considerations discussed above for matrix 130 are applicable to matrix 230. The configuration of each segment 231 may also vary significantly to have a straight or curved configuration, for example, or selected segments 231 may have a series of curves to provide a wave-like configuration. The cross-sectional shape of segments 231 may also be modified. For example, segments 231 may have a flat portion adjacent to lining 240 and an opposite surface that is curved, or segments 231 may also be round, square, or triangular. The materials discussed above for matrix 130 may also be utilized for matrix 230. Although many of the considerations discussed above for matrix 130 are applicable to matrix 230, the specific configuration of matrix 230 remains dependent upon the intended application, the material utilized, and other pertinent factors regarding the intended comfort, durability, and use of glove 200.

Matrix 230 is attached to shell 210 and lining 240 through a variety of securing methods. Area 234 is stitched to a portion of lining 240. The portions of matrix 230 that extend around the wrist are secured to lining 240 by loops of material that extend around segments 231 and are secured to lining 240. Lacing 250 may also be utilized to connect portions of matrix 230 to shell 210. Finally, segments 231 that extend into shell 210 may also be stitched directly to shell 210. Accordingly, the manner in which matrix 230 may be secured to glove 200 may vary significantly.

Figure 9:
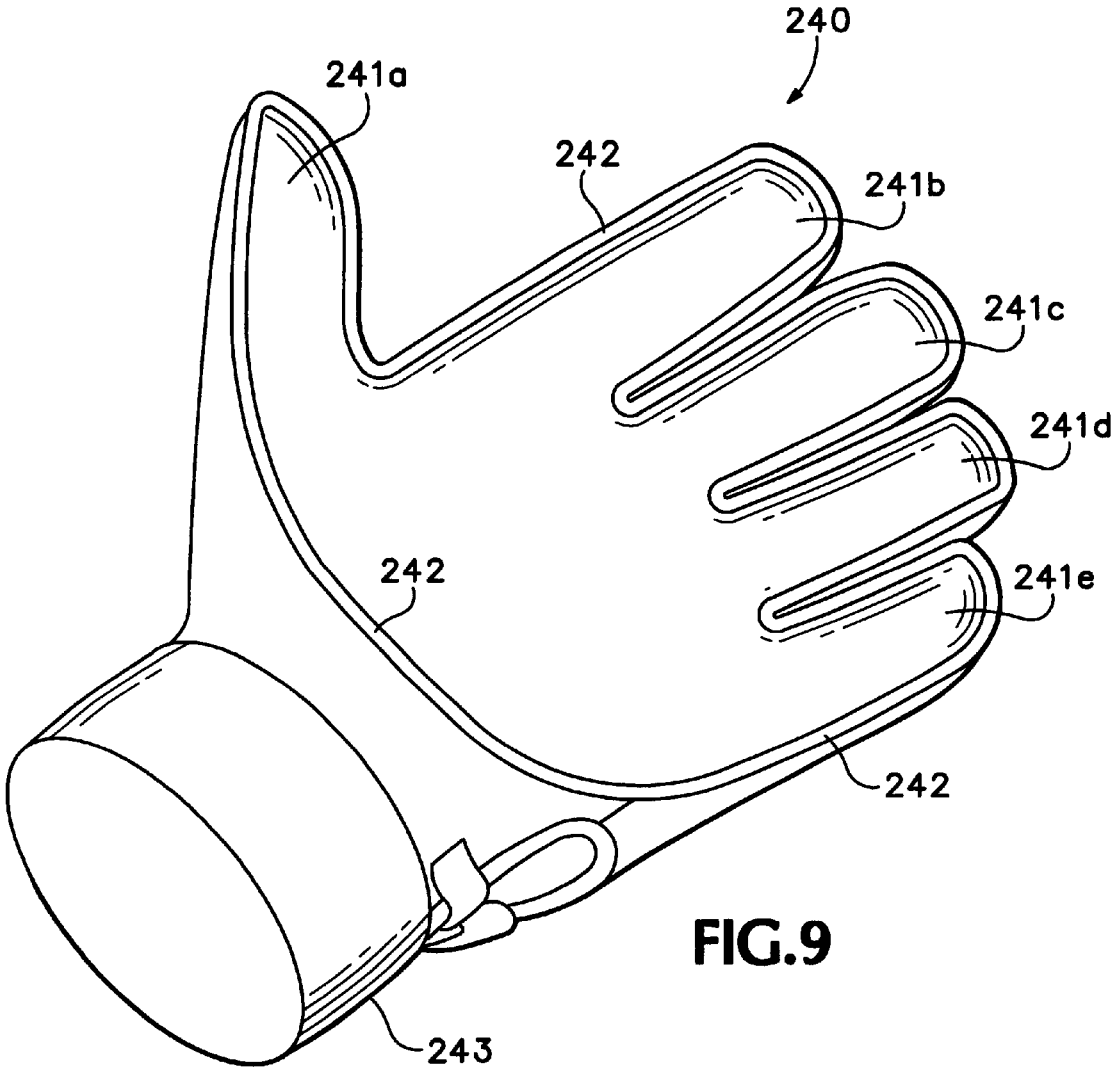
FIG. 9 is a perspective view of a lining of the second glove.
Figure 10A:
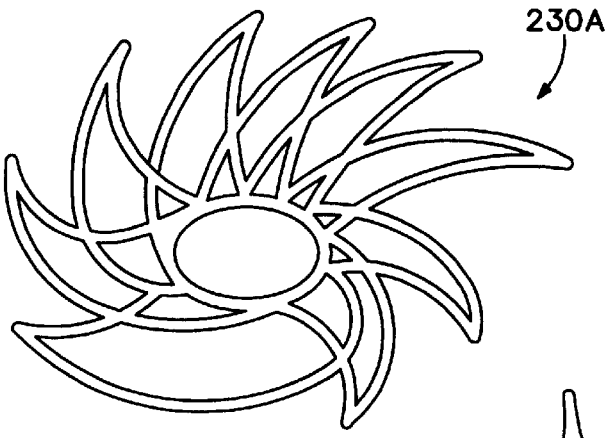
FIGS. 10A–10D are plan views of additional matrix elements.
Figure 10B:
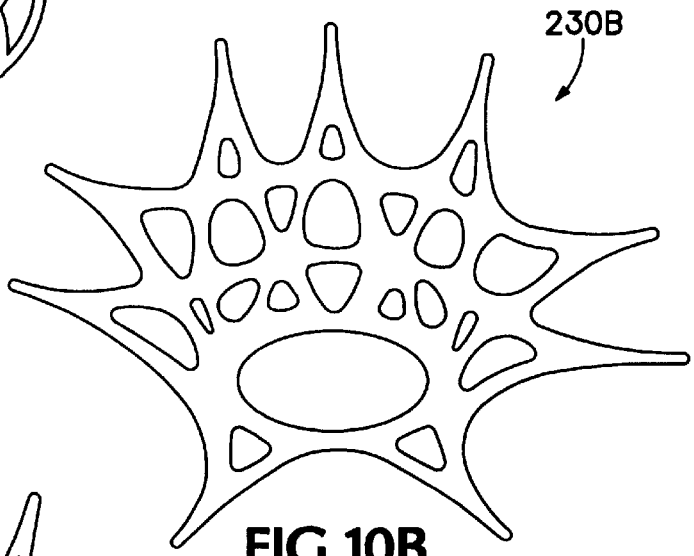
Figure 10C:
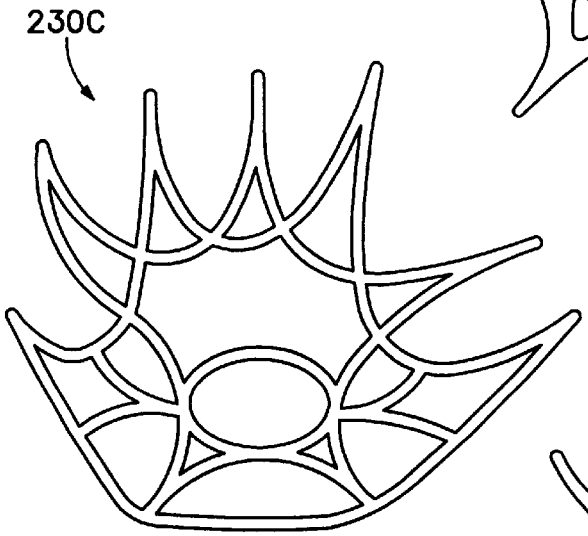
Figure 10D:
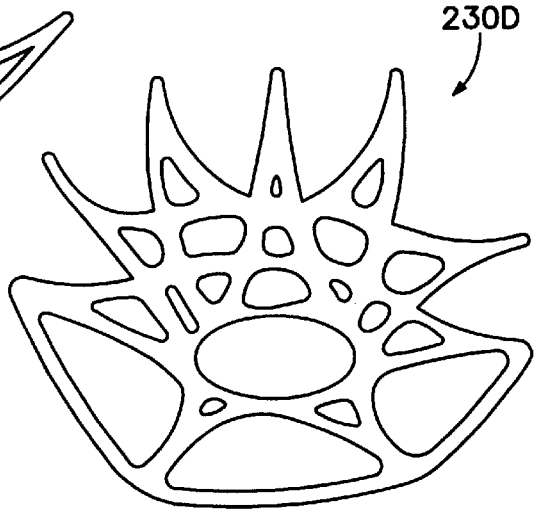

Lining 240 is located within the cavity formed by shell 210 and matrix 230 to provide a comfortable area for receiving and contacting the hand. As depicted in FIG. 9, lining 240 may have the configuration of a glove with individual finger elements 241*a*–241*e* and an absent palmar element that defines an edge 242. Lining 240 may also include a wrist strap 243 that may be selectively tightened by a conventional hook and pile fastener, for example. More specifically, lining 240 may be a glove structure that is similar to a batting glove, for example, but without a palmar element.

Lining 240 may be incorporated into glove 200 by stitching or otherwise securing edge 242 to palmar element 211. Alternately, an additional palmar liner may be secured to palmar element 211 and edge 242 may be stitched to the additional palmar liner to enhance comfort. Suitable materials for lining 240 include conventional materials for batting gloves, such as natural leather, synthetic leather, spandex, or an elastic polymer.

By selecting materials that are breathable, or materials that are perforated, the air-permeability of lining 240 may be greater than with conventional baseball gloves.

Further durability for glove 200 is provided by lacing 250, which attaches matrix 230 to shell 210 on the medial, lateral, and palmar sides of glove 200. Lacing 250 may be strips of leather or synthetic materials that extend around portions of matrix 230 and are sewn or otherwise attached to shell 210. Alternately, lacing 250 may be absent if stitching or other methods of securing portions of shell 210 together and attaching matrix 230 to shell 210 are sufficiently durable.

Glove 200 provides the advantages discussed above with respect to glove 100. In contrast with the stiff leather that is conventionally placed on the dorsal side of baseball gloves, matrix 230 is flexible, thereby increasing the overall flexibility of glove 200. This provides an advantage to athletes of all ages and skill levels in that less break-in time is required for glove 200. The weight of all-leather baseball gloves may increase the response time of athletes when attempting to catch a baseball. By eliminating a portion of the leather conventionally utilized on the dorsal space and reducing the weight of glove 200, response time may be decreased thereby enhancing the wearer's abilities. Finally, lining 240, which is formed of an glove, encompasses the hand to provide enhanced comfort and breathability.

Matrices 130 and 230 are two examples of interconnected structures suitable for the present invention. As discussed above, however, a plurality of matrix configurations may be utilized within the scope of the present invention. FIGS. 10A–10D provide four examples of other matrix configurations 230A–230D that may also be utilized in place of matrices 130 and 230.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A glove for receiving a hand of a wearer, said glove having a configuration of a baseball glove, and said glove comprising:

a shell configured to cover a palmar surface of the hand and a first portion of a dorsal surface of the hand when said glove is worn, said shell defining an open area located to correspond with a second portion of the dorsal surface of the hand; and a matrix formed of a flexible material and having a plurality of interconnected segments that define openings located between said segments, said matrix being attached to said shell and extending across said open area;

a pocket for receiving a ball, said pocket being located between a thumb region of said prove and an index finger region of said glove.

2. The glove of claim 1, wherein said shell is formed of leather.

3. The glove of claim 1, wherein said shell includes a palmar element and an opposite dorsal element joined around their peripheries, said dorsal element being located to correspond with the first portion of the dorsal surface of the hand.

4. The glove of claim 3, wherein a lower edge of said palmar element is positioned adjacent a wrist of the wearer when said glove is worn.

5. The glove of claim 3, wherein a lower edge of said dorsal element defines at least a portion of said open area and is positioned adjacent lower portions of fingers of the hand when said glove is worn.

6. The glove of claim 1, further including a liner located within a cavity formed by said shell and said matrix.

7. The glove of claim 6, wherein said liner is configured to extend around at least a portion of the hand.

8. The glove of claim 6, wherein said liner is formed of an air-permeable material.

9. The glove of claim 1, wherein said matrix extends around a wrist of the wearer when said glove is worn.

10. The glove of claim 9, wherein a portion of said interconnected segments define a wrist opening.

11. The glove of claim 10, wherein a liner extends into said wrist opening to form a cuff.

12. The glove of claim 1, wherein said matrix is stitched to said shell.

13. A baseball glove for receiving a hand of a wearer, said baseball glove comprising:

a shell configured to cover a palmar surface of the hand and a first portion of a dorsal surface of the hand when said baseball glove is worn, said shell defining an open area located to correspond with a second portion of the dorsal surface of the hand, and said shell being formed of a first material;

a second element that extends across said open area and is configured to define a wrist opening for receiving and extending around the wrist when said baseball glove is worn, said second element being formed of a second material that is substantially more elastic than said first material; and a pocket for receiving a baseball, said pocket being located between a thumb region of said baseball glove and an index finger region of said baseball glove.

14. The baseball glove of claim 13, wherein said first material is leather.

15. The baseball glove of claim 13, wherein said second material is an elastomer.

16. The baseball glove of claim 13, wherein said second material is a thermoplastic polyurethane.

17. The baseball glove of claim 13, wherein said second element is a matrix structure formed of a plurality of interconnected segments that define openings located between said segments.

18. The baseball glove of claim 13, further including a liner located within a cavity formed by said shell and said second element.

19. The baseball glove of claim 18, wherein said liner is formed of an air-permeable material.

20. The baseball glove of claim 18, wherein said liner extends into said wrist opening to form a cuff.

21. The baseball glove of claim 18, wherein said liner is a glove structure that extends within said shell of said baseball glove.

22. A baseball glove for receiving and protecting a hand of a wearer, said baseball glove comprising:

a shell formed of a palmar element and an opposite dorsal element, said palmar element covering a palmar surface of the hand and said dorsal element covering a first portion of a dorsal surface of the hand when said baseball glove is worn, said shell defining an open area located to correspond with a second portion of the dorsal surface of the hand;

a matrix formed of a flexible material and having a plurality of interconnected segments that define openings located between said segments, said matrix being attached to said shell and extending across said open area, a portion of said interconnected segments being configured to extend around a wrist of the wearer when said baseball glove is worn; and a pocket for receiving a baseball, said pocket being located between a thumb region of said baseball glove and an index finger region of said baseball glove.

23. The baseball glove of claim 22, wherein said shell is formed of leather.

24. The baseball glove of claim 22, further comprising a liner located within a cavity formed by said shell and said matrix.

25. The baseball glove of claim 24, wherein said liner is formed of an air-permeable material.

26. The baseball glove of claim 24, wherein said liner extends into said wrist opening to form a cuff.

27. The baseball glove of claim 24, wherein said liner is a glove structure that extends within said shell of said baseball glove.

28. The baseball glove of claim 22, wherein said matrix is stitched to said shell.

29. The baseball glove of claim 22, wherein said matrix defines a wrist opening.

30. The baseball glove of claim 22, wherein said matrix is configured to wrap around the wrist.

31. A baseball glove for receiving and protecting a hand of a wearer, said baseball glove comprising:

a shell for covering a palmar surface of the hand and a first portion of a dorsal surface of the hand when said baseball glove is worn, said shell defining an open area corresponding with a second portion of the dorsal surface of the hand, and said shell being formed of leather;

a matrix structure formed of a plurality of interconnected segments that define openings located between said segments, said matrix structure extending across said open area, and said matrix having a configuration that extends around a wrist of the wearer when said glove is worn, said second portion being formed of an elastomer material that is substantially more elastic than said leather;

a liner located within a cavity formed by said shell and said matrix, said liner being a glove structure for contacting the hand; and a pocket for receiving a baseball, said pocket being located between a thumb region of said baseball glove and an index finger region of said baseball glove.

32. The baseball glove of claim 31, wherein said elastomer material is a thermoplastic polyurethane.

33. The baseball glove of claim 31, wherein said liner is formed of an air-permeable material.

34. The baseball glove of claim 31, wherein said liner extends into said wrist opening to form a cuff.

35. A baseball glove for receiving and protecting a hand of a wearer, said baseball glove comprising:

a shell formed of leather and having a palmer element and an opposite dorsal element, said palmar element covering a palmar surface of the hand and said dorsal element covering a first portion of a dorsal surface of the hand when said baseball glove is worn, said shell defining an open area corresponding with a second portion of the dorsal surface of the hand;

a matrix formed of a flexible material and having a plurality of interconnected segments that define openings located between said segments, said matrix being attached to said shell and extending across said open area, a portion of said interconnected segments being configured to extend around a wrist of the wearer when said baseball glove is worn;

a liner formed of an air-permeable material and located within a cavity formed by said shell and said matrix; and a pocket for receiving a baseball, said pocket being located between a thumb region of said baseball glove and an index finger region of said baseball glove.

36. The baseball glove of claim 35, wherein said matrix includes a plurality of extensions that extend through apertures formed in said shell to connect said matrix to said shell.

37. The baseball glove of claim 35, wherein at least a portion of said matrix is stitched to said shell.

38. A glove for receiving a hand of a wearer, said glove comprising:

a shell configured to cover a palmar surface of the hand and a first portion of a dorsal surface of the hand when said glove is worn, said shell defining an open area located to correspond with a second portion of the dorsal surface of the hand; and a matrix formed of a flexible material and having a plurality of interconnected segments that define openings located between said segments, said matrix being attached to said shell and extending across said open area, and said matrix including a plurality of extensions that extend through apertures formed in said shell to connect said matrix to said shell.

39. A baseball glove for receiving and protecting a hand of a wearer, said baseball glove comprising:

a shell formed of a palmar element and an opposite dorsal element, said palmar element covering a palmar surface of the hand and said dorsal element covering a first portion of a dorsal surface of the hand when said baseball glove is worn, said shell defining an open area located to correspond with a second portion of the dorsal surface of the hand;

a matrix formed of a flexible material and having a plurality of interconnected segments that define openings located between said segments, said matrix being attached to said shell and extending across said open area, a portion of said interconnected segments being configured to extend around a wrist of the wearer when said baseball glove is worn, and said matrix including a plurality of extensions that extend through apertures formed in said shell to connect said matrix to said shell; and a pocket for receiving a baseball, said pocket being located between a thumb region of said baseball glove and an index finger region of said baseball glove.

* * * * *